US005582254A

United States Patent [19]

Píštěk

[11] Patent Number: 5,582,254

[45] Date of Patent: Dec. 10, 1996

[54] PRESSURE CONTAINER, ESPECIALLY FOR A FIRE EXTINGUISHING AGENT

[76] Inventor: Václav Píštěk, 687 25, Hluk č 497, Czech Rep.

[21] Appl. No.: 537,761

[22] PCT Filed: Apr. 14, 1994

[86] PCT No.: PCT/CZ94/00013

§ 371 Date: Oct. 20, 1995

§ 102(e) Date: Oct. 20, 1995

[87] PCT Pub. No.: WO94/23799

PCT Pub. Date: Oct. 27, 1994

[30] Foreign Application Priority Data

Apr. 20, 1993 [CZ] Czech Rep. ..... 675-93

[51] Int. Cl.[6] ..... A62C 13/62

[52] U.S. Cl. ..... 169/73; 169/30; 169/85

[58] Field of Search ..... 169/26, 29, 30, 169/71, 72, 73, 85, 36; 222/386.5, 54, 635, 183, 212

[56] References Cited

U.S. PATENT DOCUMENTS

| | | | |
|---|---|---|---|
| 458,171 | 8/1891 | Johnson | 169/26 |
| 4,458,830 | 7/1984 | Werding | 222/386.5 |
| 5,044,524 | 9/1991 | Píštěk | 222/386.5 |
| 5,111,971 | 5/1992 | Winer | 222/386.5 |
| 5,127,554 | 7/1992 | Loychuk | 222/386.5 |
| 5,156,309 | 10/1992 | Friedrich | 222/386.5 |

FOREIGN PATENT DOCUMENTS

| | | | |
|---|---|---|---|
| 1335303 | 9/1987 | U.S.S.R. | 169/26 |
| 1607833A | 11/1990 | U.S.S.R. | 169/36 |

*Primary Examiner*—Gary C. Hoge

*Attorney, Agent, or Firm*—Beveridge, DeGrandi, Weilacher & Young, LLP

[57] ABSTRACT

A pressurized container consisting mainly of a protective flask, a lid, an elastic storage bag disposed within the flask, and a working bag disposed within the elastic storage bag. The elastic storage bag is filled with a predetermined amount of a desired medium to be dispensed. Then, the working bag is filled with air or another appropriate working fluid. The pressure exerted from the working bag on the elastic storage bag causes the elastic storage bag to expand until lining the interior of the protective flask. A deaerating vent is provided on the protective flask to allow air trapped between the elastic bag and the protective flask to escape. The added pressure supplied by the working bag assures that all of the contained medium will be dispensed. The protective flask also may include an opening and a puncturing tip covered by a thermal fuse. When the thermal fuse melts, the puncturing tip ruptures the elastic storage bag, thereby dispensing the medium contained inside.

3 Claims, 1 Drawing Sheet

PRESSURE CONTAINER, ESPECIALLY FOR A FIRE EXTINGUISHING AGENT

FIELD OF THE INVENTION

The invention relates to a pressure container, especially for a fire-extinguishing agent, comprising a protective flask made e.g. of aluminium or plastic material and provided with a deaerating vent and in the upper part with a neck having an upwards opened circular bed formed at its inner periphery, there being a lid with a pressure valve removably fixed on the neck.

BACKGROUND OF THE INVENTION

Known pressure containers are usually formed by a metal pressure vessel in which a utility agent, e.g. hair lacquer, perfume, liquid soap, mustard etc., is placed. To force the utility agent out of the pressure container producers usually use freon, but at present also less harmful agents such as propane-butane are used. It is also known to use air in containers, usually provided with a special arrangement of the inner space of the pressure vessel for not allowing the agent to contact the air.

Another known solution is a use of memory characteristics of elastic material, e.g. of a rubber, to force out the utility agent.

Yet another known solution is a pressure container comprising a protective flask in which an elastic bag is arranged, the elastic bag being sealed to a charge and discharge valve situated in the lid of the protective flask. In this known solution, in order to prevent a contact between the utility agent and the inner surface of the elastic bag, a foil which is inert to the utility agent and which is fixed also to the valve is used. The utility agent is forced out of the pressure container by the contraction of the elastic bag.

There is no gaseous working medium used in the above mentioned case. Its practical use is nevertheless problematic because a relatively large content remains in the elastic bag and cannot be forced out by said bag.

Another pressure container comprising also just a protective flask, e.g. of a plastic material, is provided with a closed hollow elastic storage bag sealed by the lid periphery, and with a charge valve which serves at the same time as a discharge valve arranged over the elastic storage bag and in the lid. The discharging of the utility agent out of the space above the upper part of the closed concave elastic storage bag is performed in this case by contraction of the material of the concave upper part of the closed hollow storage bag. Then in the last phase it is performed by expansion of the gaseous medium compressed during filling of the pressure container inside of the closed hollow elastic storage bag which results in complete discharge of the utility agent.

Hand-operated fire-extinguishers, beside other fire-extinguishing means, are also known and used. These hand-operated fire-extinguishers comprise usually steel pressure container with a fire-extinguishing agent, e.g. with water, powder, foam, etc., which is either under constant pressure of gas, or which is provided with a closed, easily breakable ampule with a chemical creating over-pressure when mixed with water or other chemical, the overpressure being able to discharge the fire-extinguishing agent out from the fire-extinguisher.

The use of pressure container with freon serving as the working medium is on the decline, due to the well known reasons. When using other working media it is necessary to take various steps to prevent any contact between the working medium and the utility agent, and this leads to an increase of operating costs. Besides that, the propane-butane, which is used in such devices, is an inflammable gas. This property excludes the possibility of using said gas e.g. in fire-extinguishers. That goes for air as well, as the contact between the air and the utility agent is usually undesirable and if used in a fire-extinguisher it would support the fire.

It is not advantageous to use chemicals to create an overpressure in fire-extinguishers. A disadvantage of some of the fire-extinguishers is namely the possibility of their explosion.

SUMMARY OF THE INVENTION

The mentioned disadvantages are removed or at least moderated by a pressure container, especially for fire-extinguishing agent, comprising a protective flask made e.g. of aluminium or plastic material and provided with a deaerating vent and in the upper part with a neck having an upwards opened circular bed formed at its inner periphery, there being a lid with a pressure valve removably fixed on the neck, the gist of the solution of the problem being that between said circular bed and said lid a bead of an elastic storage bag is clamped, said bead being partly inserted into the inner area of the protective flask, while to said pressure valve a working bag is fastened, said working bag being partly inserted into the inner area of the elastic storage bag, into which a charge and discharge valve, built in in the lid and provided outside thereof with a spraying discharge nozzle.

It is advantageous to provide the casing of the protective flask with at least one outlet with a tip covered by a thermal fuse at a place opposing the outer wall of the elastic storage bag.

It also advantageous to form the thermal fuse of a fire meltable or combustible material.

An advantage of the present pressure container is that it does not use harmful agents for discharging of the pressure flask, it makes repeated use possible, no explosion danger of the pressure flask threatens as it may especially when using known fire-extinguishers. Another advantage is a complete discharge of the content of the fire-extinguisher. When used as fire-extinguisher, the present invention makes it possible to use both the discharge valve and the outlets with thermal fuses, which enables e.g. throwing of the pressure container directly into the fire and in such a way to increase the fire-extinguishing effect. There may be formed a barrier for prevention of fire spreading. The pressure container may also be arranged as a precaution in places where fire could arise, e.g. in motor space of motor vehicles. The elastic storage bag of the pressure container may be filled not only with water but also with other fire-extinguishing agents, such as powder, foam, trichloroethylene etc.

BRIEF DESCRIPTION OF THE DRAWINGS

A preferred embodiment of the invention will be described with reference to the accompanying drawings, in which.

DETAILED DESCRIPTION OF THE EMBODIMENT

Figure 1:
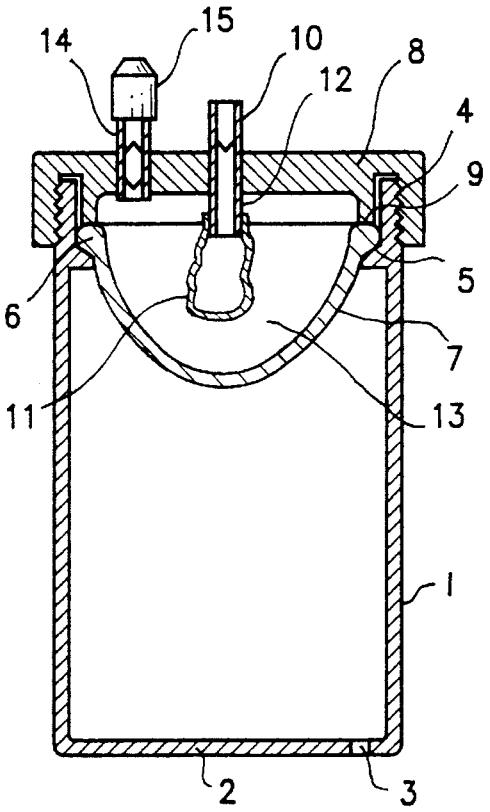
FIG. 1 shows an empty pressure container in a vertical axial section.
Figure 3:
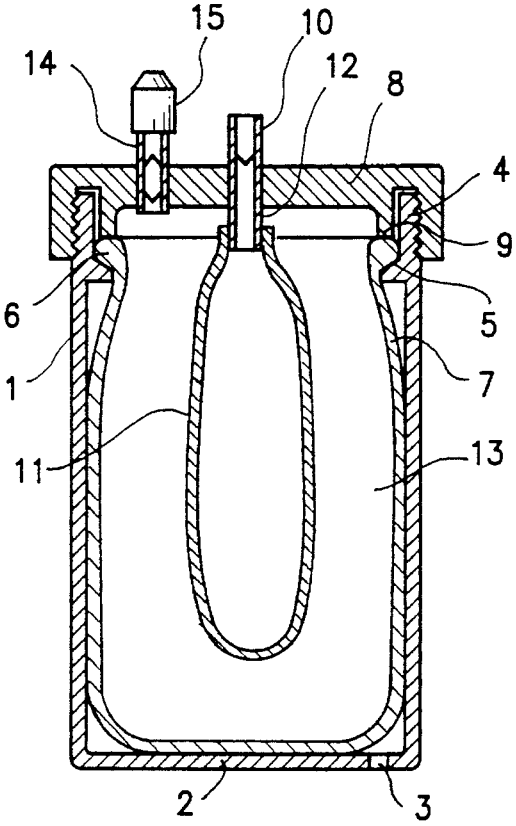
Figure 2:
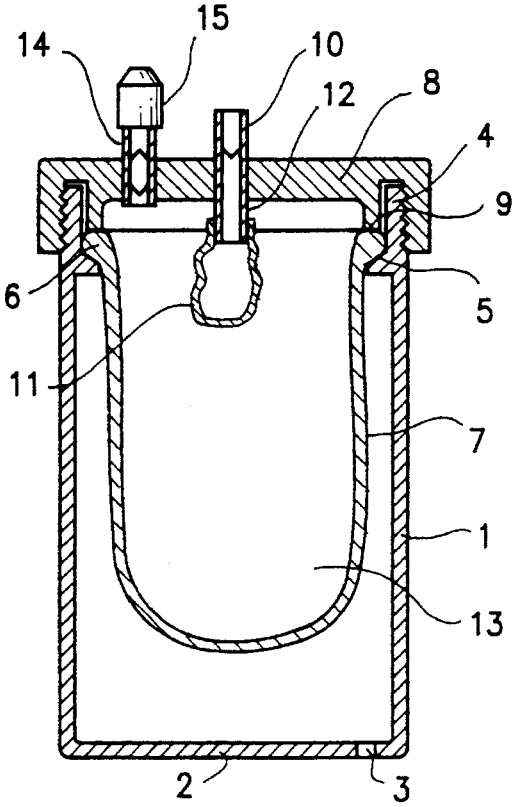
FIG. 2 shows a pressure container filled with fire-extinguishing agent in a vertical axial section, FIG. 3 a pressure container in the state of preparedness in a vertical axial section, and FIG. 4 an outlet with a thermal fuse in a vertical axial section.
Figure 4:
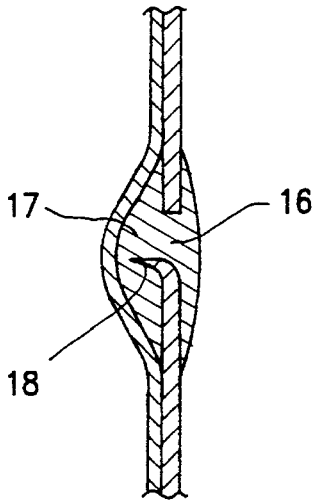

The pressure container comprises a protective flask 1 which is made of aluminium or plastic material and which is provided, preferably at its bottom 2, with a deaerating vent 3, and at its top part, with a neck 4. The neck 4 is provided, at its inner periphery, with a circular bed 5 which is open in upward direction, and in which an elastic storage bag 7 for fire-extinguishing agent is inserted with its bead 6. The neck 4 is covered by a lid 8, which is preferably bolted to the neck 4, the peripheral part of the front surface 9 of the lid 8 adjoining the bead 6 of the elastic storage bag 7. A common pressure valve 10 is built in the lid 8 and mouths in a working bag 11 which is fastened e.g. to a sleeve 12 of the pressure valve 10 and which is partly inserted into the inner area 13 of the elastic storage bag 7. The working bag 11 is intended to be filled with a compressible, preferably incombustible gas, e.g. nitrogen or air with possible addition of fire-extinguishing agent, e.g. a powder.

Besides the pressure valve 10 another charge and discharge valve 14 for fire-extinguishing agent is arranged in the lid 8. The valve 14 mouths in the inner area 13 of the elastic storage bag 7 and is provided with e.g. a spraying discharge nozzle 15 outside of the lid 8. In case the elastic storage bag is intended to be filled with an agent behaving aggressively to the material of the elastic storage bag 7, the elastic storage bag 7 may be provided with a separating foil (not shown) at its inner surface. The casing of the protective flask 1 may be provided with at least one outlet 16 with a thermal fuse 17 made as a protective cover of a tip 18 protruding against the wall of the elastic storage bag 7 and created e.g. by curving the material of the cover of the protective flask 1 in the proximity of the outlet 16. In case the cover of the protective flask 1 is made of plastic material, the tip may be formed of a metal and may be fixed to the cover of the protective flask 1 in the proximity of the outlet 16. The thermal fuse 17 is made of a material meltable or combustible by fire, e.g. of a wax or plastic material with a low fusing or burning temperature.

When assembling the pressure container the elastic storage bag 7 is inserted into the protective flask until the bead 6 of said elastic storage bag 7 fits into the circular bed 5. Then the lid 8 with the working bag 11 at its pressure valve 10 is set on the neck 4 and the is secured e.g. by screwing on, whereby the bead 6 of the storage bag 7 is tightly clamped.

The filling of the assembled pressure container, e.g. with a fire-extinguishing agent, is performed through the charge and discharge valve 14 into the inner area 13 of the elastic storage bag 7, the cover of which extends and almost fills the inner space of the protective flask 1 from which the air leaks through the deaerating vent 3. Thereafter, or, alternatively, before it is set ready, the pressure gas, preferably nitrogen, is forced from a pressure medium supply through pressure valve 10 into the working bag 11. Hereby the elastic storage bag 7 is pressed against the inner wall and against the bottom 2 of the protective flask 1 and at the same time against the thermal fuse 17 of the outlet 16.

It is possible to use the described pressure container in two ways. One way is putting of the spraying discharge nozzle 15 on the charge and discharge valve 14. In this case it is possible to spray the fire-extinguishing agent from the elastic storage bag 7 by turning on the charge and discharge valve 14, whereby the fire-extinguishing agent is pressed by both the force accumulated in the material of the elastic storage bag 7 and by the pressure, e.g. of the nitrogen, in the working bag 11, which secures constant and complete discharge of the fire-extinguishing agent.

The other way of using of the pressure container is that it is thrown into a fire, wherein, after melting or combustion of the thermal fuse 17 the bared tip 18 punctures the elastic storage bag 7 and the fire-extinguishing agent begins to stream out of it through the outlet 16 into the fire and extinguishes the fire. This action may be performed also when the pressure container is arranged in a place where a fire may occur and when the fire breaks out, e.g. in the motor area of a vehicle.

INDUSTRIAL APPLICABILITY

The pressure container may be used for various agents, such as liquid soap, tooth paste, ketchup, mustard etc., but especially for fire-extinguishing agents, which turn the pressure container in a fire-extinguisher.

I claim:

1. A pressure container comprising:

a protective flask having a neck portion defining an upwards opened circular bed about its inner periphery;

a lid removably attached to said neck portion, an elastic storage bag within said flask, said elastic storage bag having a bead disposed about its open end, said bead being clamped between said circular bed and said lid and supporting said elastic storage bag within said flask, a charge and discharge value on said lid and providing communication with the interior of said elastic storage bag, said charge and discharge value having a spraying discharge nozzle outside of said lid, a pressure valve extending through said lid, a working bag fastened to said pressure valve and extending into said elastic storage bag, said protective flask having a deaerating vent whereby air in said flask is forced out of said flask as said elastic storage bag is inflated within said flask.

2. A pressure container as defined in claim 1, wherein said protective flask includes at least one outlet therethrough and a pointed tip adjacent said outlet and extending inwardly into said flask, a thermal fuse covering said pointed tip and said outlet, said thermal fuse being in contact with the exterior wall of said elastic storage bag when said bag is under compression within said flask.

3. A pressure container as defined in claim 2, wherein said thermal fuse is made of a fire meltable or combustible material.

* * * * *